United States Patent [19]

Wenkman et al.

[11] Patent Number: 4,953,747

[45] Date of Patent: Sep. 4, 1990

[54] TABLE MODEL NAPKIN DISPENSER

[76] Inventors: Gregory J. Wenkman, 6690 Shamrock Glen Cir., Middleton, Wis. 53562; Ferdinand F. Salzmann, 605 Ray St., Prairie du Sac, Wis. 53578

[21] Appl. No.: 178,575

[22] Filed: Apr. 7, 1988

[51] Int. Cl.[5] ..... A65D 83/00

[52] U.S. Cl. ..... 221/45; 221/35; 221/56; 221/305

[58] Field of Search ..... 221/35, 45, 52, 59, 221/60, 305

[56] References Cited

U.S. PATENT DOCUMENTS

| | | | |
|---|---|---|---|
| D. 263,669 | 4/1982 | Collins | D7/72 |
| 1,853,407 | 4/1932 | Cofrin | 221/35 |
| 1,894,589 | 1/1933 | Horwitt | 221/56 |
| 2,011,403 | 8/1935 | Gessler | 221/35 |
| 2,027,670 | 1/1936 | Broeren | 221/35 |
| 2,426,787 | 9/1947 | O'Neil | 221/45 |
| 2,537,050 | 1/1951 | Gluck | 221/45 |
| 3,203,586 | 8/1965 | Downham | 221/55 |
| 3,208,636 | 9/1965 | Filipowicz | 221/57 |
| 3,214,227 | 10/1965 | Filipowicz | 312/71 |
| 3,307,740 | 3/1967 | Fant | 221/45 |
| 3,307,748 | 2/1968 | Koerper et al. | 221/59 |
| 4,329,001 | 5/1982 | Filipowicz et al. | 312/71 |

FOREIGN PATENT DOCUMENTS

| | | | |
|---|---|---|---|
| 2591199 | 6/1987 | France | 221/305 |

*Primary Examiner*—Andres Kashnikow
*Assistant Examiner*—Matthew C. Graham
*Attorney, Agent, or Firm*—Quarles & Brady

[57] ABSTRACT

A napkin dispenser (10) is disclosed that is a self-contained unit that may be set upon a surface such as a table, counter, or the like. The napkin dispenser (10) has a front (14) and back (16) that oppose one another, each end having hinged doors (26) that may be opened for loading of napkins. The napkin dispenser (10) is symmetrical on a plane equidistant from the doors (26). The doors (26) have access windows (30) through which napkins may be extracted individually. The pressure plates (34) push the napkin against the doors (26), the pressure plates (34) being biased by a leaf spring (62). The spring (62) has a single leaf that is attached to the underside of the top (18) of the napkin dispenser (10) and to the back side of each of the pressure plates (34). The spring is positioned at an angle of 45° relative to a line normal to the surface upon which the napkin dispenser (10) may be set, and the spring (62) is routred over a top (72) on the back side of the pressure plates (34). The spring angle and tab (72) provide a force profile against the napkins that allows for ease of extraction of the napkins by the user. The napkin dispenser has integral base (36) and side walls (38) against which the edges of the napkins rest and are molded in one flat piece. The napkin dispenser (10) also features an anchor clip (32) that allows for attachment and detachment of the napkin dispenser (10) from the surface on which it rests. The anchor clip (32) is fixed to the surface by adhesive foam tape (48) and has barbs (44) that extend vertically into two slots (42) in the bottom of the napkin dispenser (10). The anchor clip (32) may be detached from the remainder of the napkin dispenser (10) by accessing the barbs (44) that have been inserted into the slots (42) in the bottom (20) by opening of the doors (26) and by pinching of the barbs (44) together.

3 Claims, 11 Drawing Sheets

TABLE MODEL NAPKIN DISPENSER

FIELD OF THE INVENTION

This invention relates to devices for dispensing of folded sheet materials, such as napkins.

BACKGROUND OF THE INVENTION

Folded paper napkin dispensers are self-contained units that comprise an enclosed cabinet for holding a supply of napkins from which the napkins may be individually removed by users. Such napkin dispensers are common to restaurants and lunch rooms and are typically adapted for placement upon a table or counter. Because of their ease of transport and because they are typically in areas of the restaurant where customers wait on or serve themselves without surveillance, napkin dispensers become a target for potential theft by customers. Restaurants may then be subject to losses resulting from the replacement costs of these napkin dispensers, or the additional labor costs to allow for observation of the customers.

In the design of a napkin dispenser, it is important to provide for a proper force profile against the napkins so that the individual napkins may be removed easily with the correct drag. The proper force profile against the napkins is especially difficult to maintain as the number of napkins in the napkin dispenser varies. It is not uncommon for a customer or user to have difficulty extracting napkins when the dispenser is filled to capacity, or drawing out more napkins than needed when the number of napkins in the dispenser is more depleted. The problem may be exacerbated when the napkins are dispensed from two opposing sides, and each of the sides are unevenly loaded with napkins. The result is a potential waste of the napkins, or in user frustration.

SUMMARY OF THE INVENTION

In accordance with the present invention, a napkin dispenser is disclosed having an anchor clip which secures the napkin dispenser to the table or counter, pressure plates that provide the proper force profile against the napkins, and an integral base and side wall which is molded in one flat piece. The anchor clip which secures the napkin dispenser to the table or counter is a flat plate with two vertical barbs that mate with two slots in the bottom of the cabinet of the napkin dispenser. The side of the flat plate opposite the vertical barbs has adhesive foam tape that affixes the anchor clip to the desired location on a table or counter. The anchor clip is then correspondingly attached to the cabinet of the napkin dispenser by inserting the vertical barbs into the slots in the bottom of the cabinet of the napkin dispenser; the vertical barbs then snap into the slots and lock in place. The cabinet of the napkin dispenser may be opened, and upon removal of any remaining napkins, the penetration of the two vertical barbs through the two slots may be exposed. When the barbs are pinched together, the cabinet of the napkin dispenser may be liberated from the anchor clip for cleaning or maintenance.

Two opposing sides of the cabinet of the napkin dispenser have windows through which the user may extract napkins individually. Each of these opposing sides may be opened for loading or removal of napkins, and each of the sides has an independent pressure plate that presses against the napkins that are loaded on each side. The pressure plates are spring-loaded by a strip of metal that slides into accommodating grooves in the back of the pressure plates. The strip of metal is then routed over a tab on the rear side of each of the pressure plates, and 1 this results in the pressure plates being canted in such a way so as to provide for a proper force profile against the napkins.

The interior of the cabinet of the napkin dispenser features an integral base and side wall which is molded in the flat and incorporates a hinged side wall which guides the napkins to the front access window of the dispenser. It is, of course, desirable to produce a unit that is economical to manufacture. Since some parts of a napkin dispenser are plastic injection molded, it is more economical if parts such as the base and side wall can be consolidated to decrease the number of moldings required. The side wall incorporates a pressure plate stop so that an equal number of napkins can be placed into each end of the dispenser.

Further objects, features, and advantages of the invention will be apparent from the following detailed description taken in conjunction with the accompanying drawings.

DESCRIPTION OF THE PREFERRED EMBODIMENT

Figure 1:
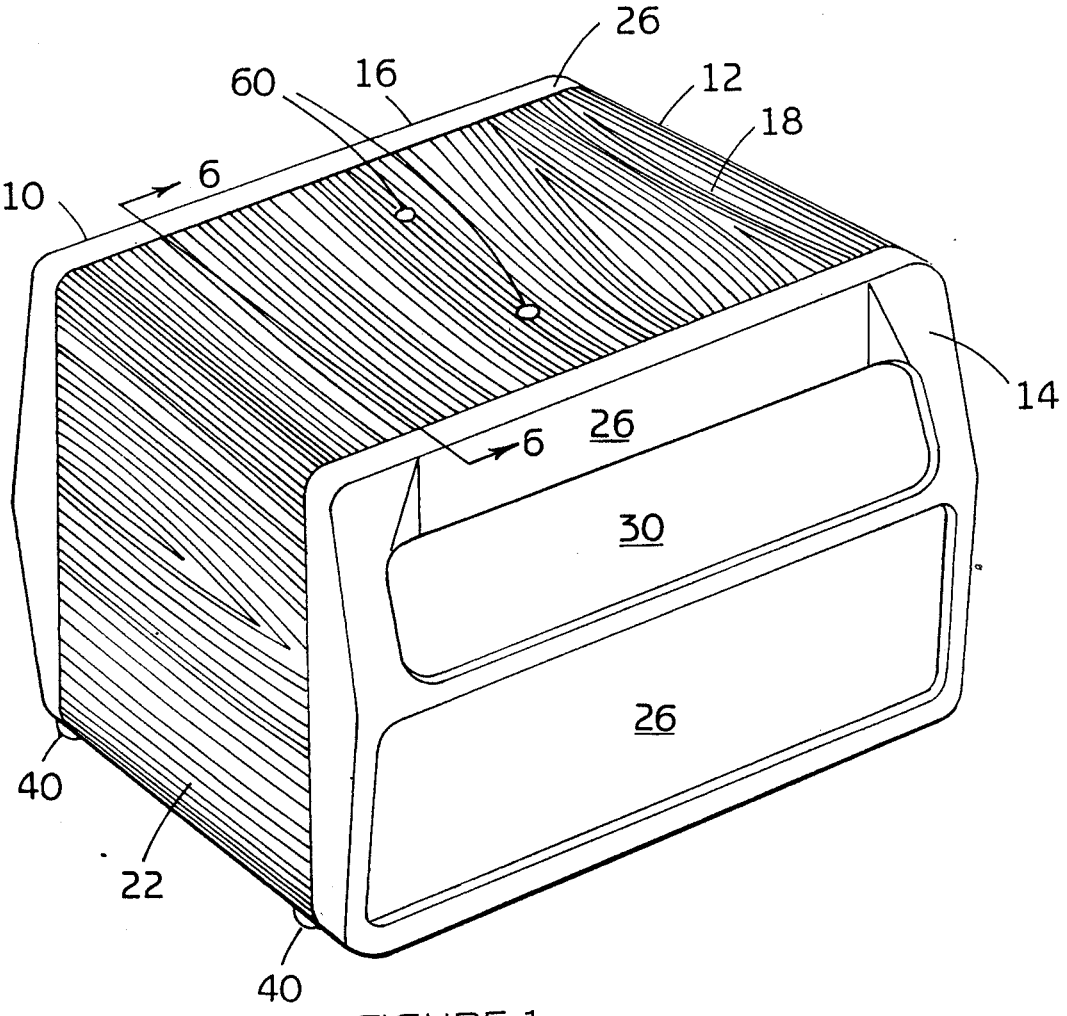
FIG. 1 is a perspective view of the outside of the table model napkin dispenser.
Figure 2:
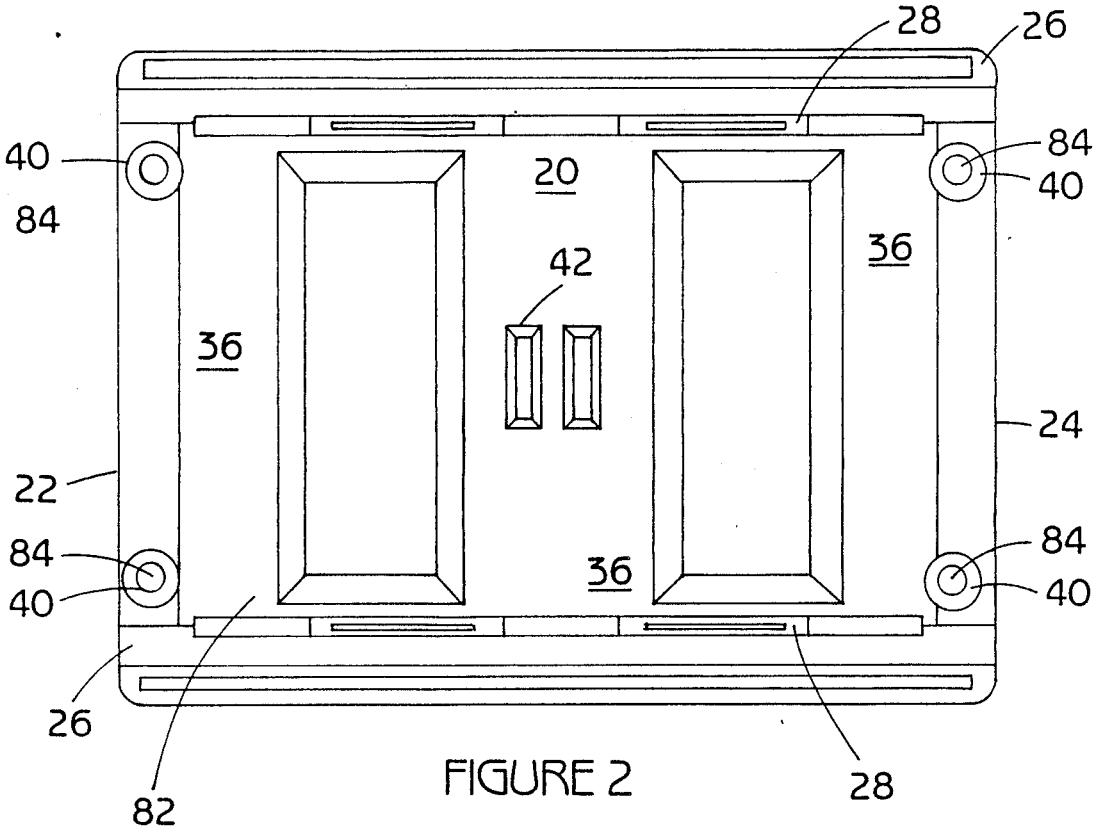
FIG. 2 is a bottom view of the outside of the table model napkin dispenser, with the anchor clip removed.
Figure 3:
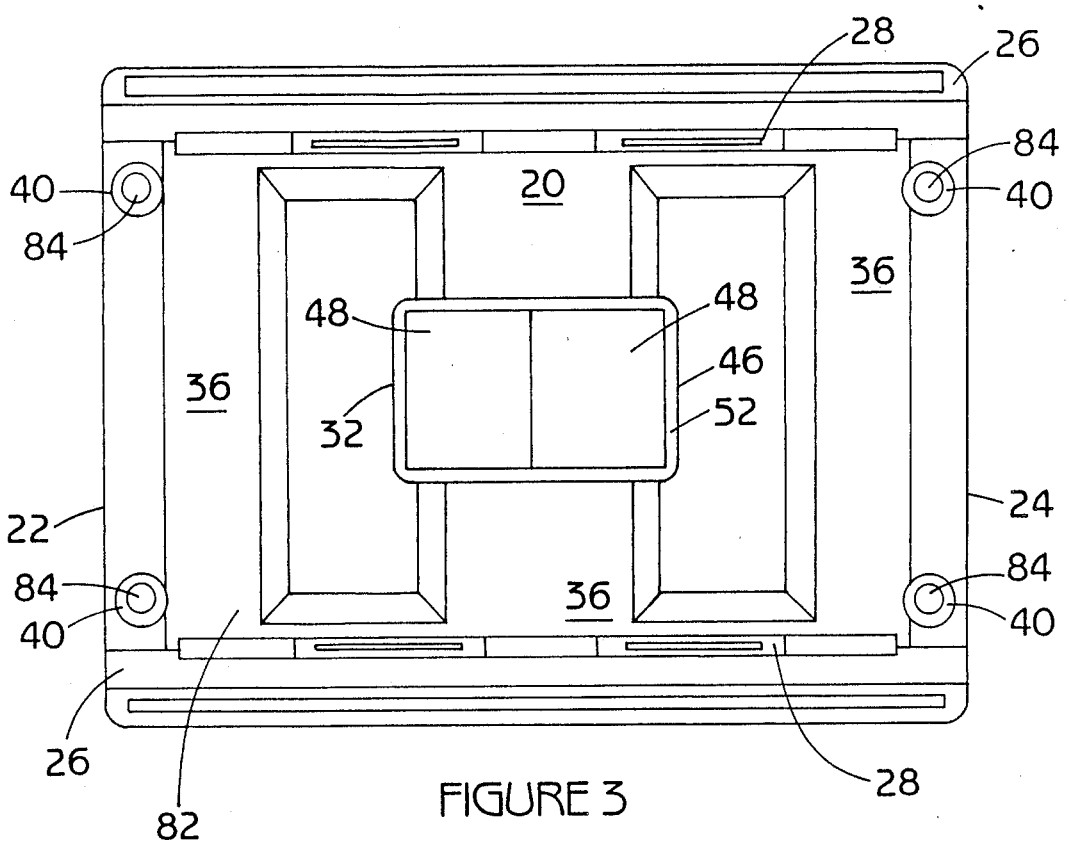
FIG. 3 is a bottom view of the outside of the table model napkin dispenser, with the anchor clip installed.
Figure 4:
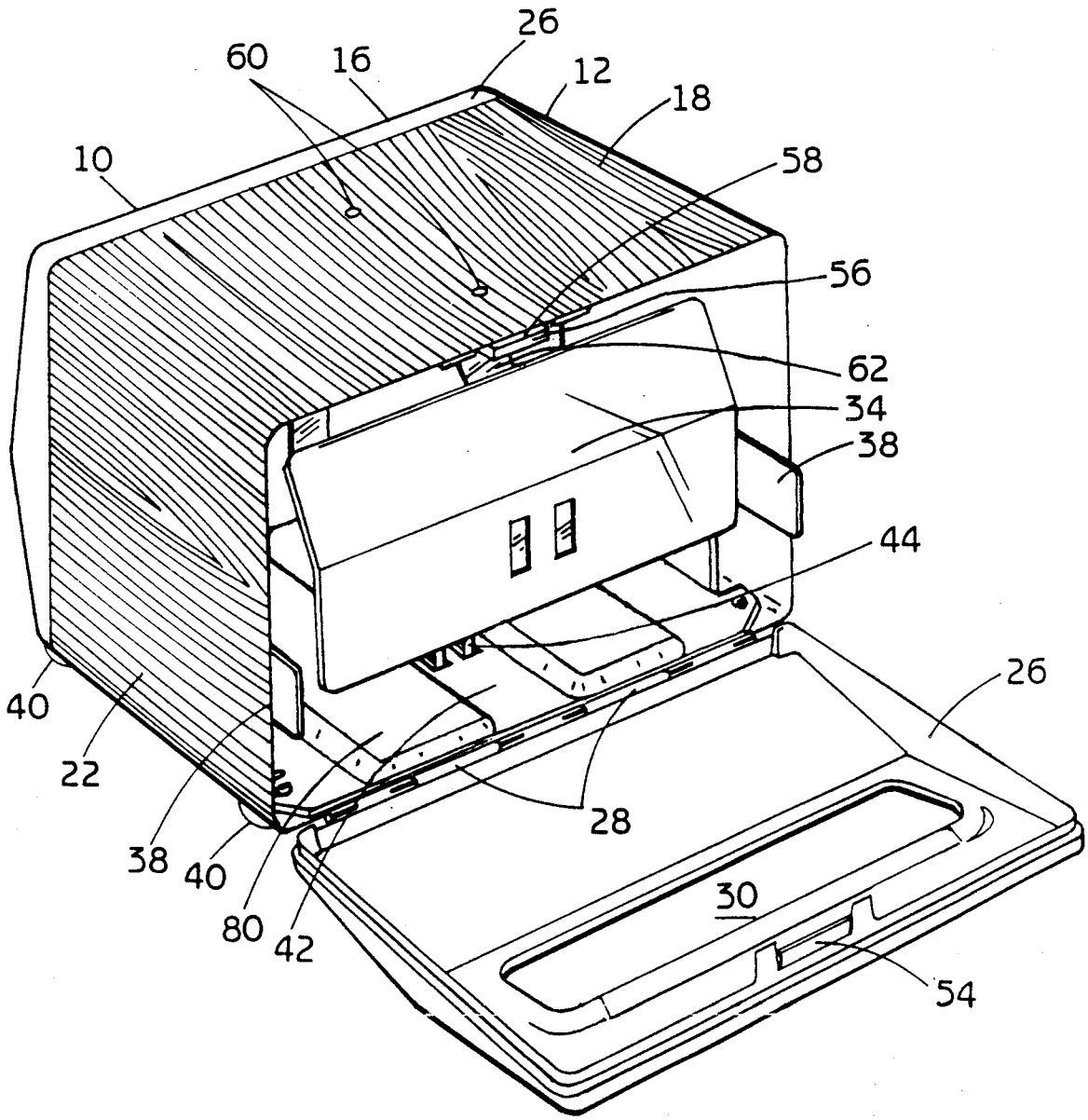
FIG. 4 is a perspective view of the table model napkin dispenser, with a door open to expose the internal elements of the napkin dispenser.
Figure 5:
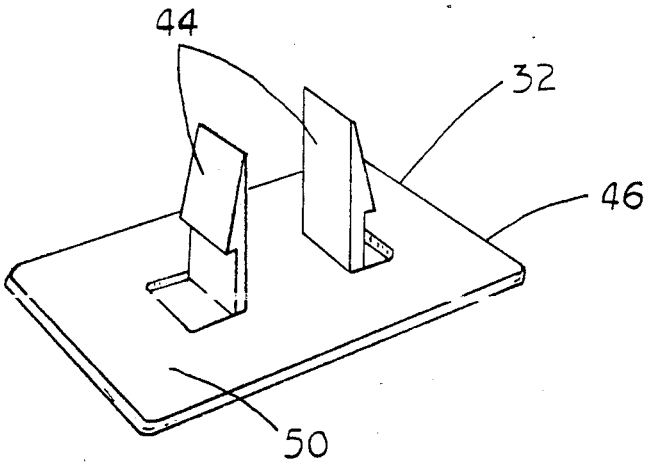
FIG. 5 is a perspective view of the anchor clip.

With reference to the drawings, a preferred embodiment of a table model napkin dispenser constructed in accordance with the invention is shown generally at 10 in FIG. 1. As viewed from the exterior, the napkin dispenser includes a cabinet 12 having a front 14, a back 16, a top 18, a bottom 20, and two sides 22 and 24. The front 14 and back 16 oppose each other and are formed by two doors 26 that have hinges 28 at the bottom of the doors 26. Each door 26 has an access window 30 through which napkins may be individually extracted by the user. The napkin dispenser 10 features an anchor clip 32 that affixes the napkin dispenser 10 to a table, counter, or the like, but which may be liberated from the cabinet 12 of the napkin dispenser 10. FIG. 5 shows the anchor clip 32 independent from the cabinet 12 of the napkin dispenser 10. FIGS. 2 and 3 show the bottom 20 of the napkin dispenser 10, the former figure depicting the napkin dispenser 10 without the anchor clip 32 in place, the latter figure depicting the napkin dispenser 10 with the anchor clip 32 installed. Upon opening of either of the doors 26, additional features of the napkin dispenser 10 on the interior of the cabinet 12 are made visible. These features include two identical pressure plates 34, one pressure plate 34 behind each of the doors 26. The napkins to be dispensed are stacked and fit between the doors 26 and the pressure plates 34, and the napkins are bounded at their edges by a base 36 and side walls 38.

The napkin dispenser 10 is symmetrical along an axis equidistant from each of the doors 26 and any reference to the front 14 is equally applicable to the back 16, and vice versa. A distinction between the front 14 and the back 16 is maintained in this description for purposes of clarity. The front 14 and back 16 each have doors 26 that are hinged to the cabinet 12 by hinges 28. The doors 26 are preferably composed of polycarbonate; the cabinet 12 is preferably composed of 0.032 inch thick cold rolled steel that is coated with 0.008 inch thick vinyl. The doors 26 may be opened so as to load the napkin dispenser 10 with napkins that fit between the pressure plate 34 and the doors 26. The front 14 and the back 16 are loaded with napkins independently of each other.

The bottom 20 of the cabinet 12, as shown in FIGS. 2 and 3, has four rubber legs 40 upon which the cabinet 12 rests on a table, counter, or the like. The bottom 20 is substantially composed of the obverse side of the base 36 that is visible when viewing the interior of the napkin dispenser 10. As shown in FIG. 2, the bottom 20 of the cabinet 12 also has two centrally located slots 42 in the base 36 that are adapted to receive two vertical barbs 44 of the anchor clip 32. The anchor clip 32 is shown independently in FIG. 5, the anchor clip 32 being comprised of the vertical barbs 44, a flat plate 46, and strips of adhesive foam tape 48. The vertical barbs 44 extend outward from a first side 50 of the flat plate 46, and the adhesive tape 48 is affixed to a second side 52 of the flat plate 46 that opposes the first side 50. The adhesive foam tape 48 is double-sided, and one side of the foam tape is affixed to the second side 52 of the flat plate 46. The other side of the foam tape 48 is used by the owner of the napkin dispenser 10 to affix the anchor clip 32 to a surface such as a table, a counter, or the like. The owner of the napkin dispenser 10 may then secure the cabinet 12 to the table, counter, or the like by inserting the vertical barbs 44 through the slots 42. The vertical barbs 44 snap into place behind the base 36, and the napkin dispenser 10 is thereby secured to the surface. When the doors 14 are opened and napkins are removed or depleted, the vertical barbs 44 that have been inserted through the slots 42 of the base 36 are exposed. The cabinet 10 may be liberated from the anchor clip 32 by pinching of the vertical barbs 44 together. This may be done by the user or owner to clean the area, for ease in loading of the napkins, or other maintenance purposes.

In the loading of a stack of napkins into the napkin dispenser 10, the napkins are placed between the pressure plates 34 and the doors 26. When the doors 26 are closed, pressure is exerted by the pressure plates 34 on the stack of napkins against the doors 26. The doors 26 are snapped shut by an engagement of a first dog 54 on the inside top of each respective door 26 with a second dog 56. When the door is snapped shut, the first dog 54 fits between a respective second dog 56 and the underside of the top 18 of the cabinet 12. There is a second dog 56 for each of the respective doors 26 and the second dogs 56 oppose each other, forming part of a clip 58 that is attached to the underside of the top 18 of the cabinet 12 by rivets 60.

Figure 6:
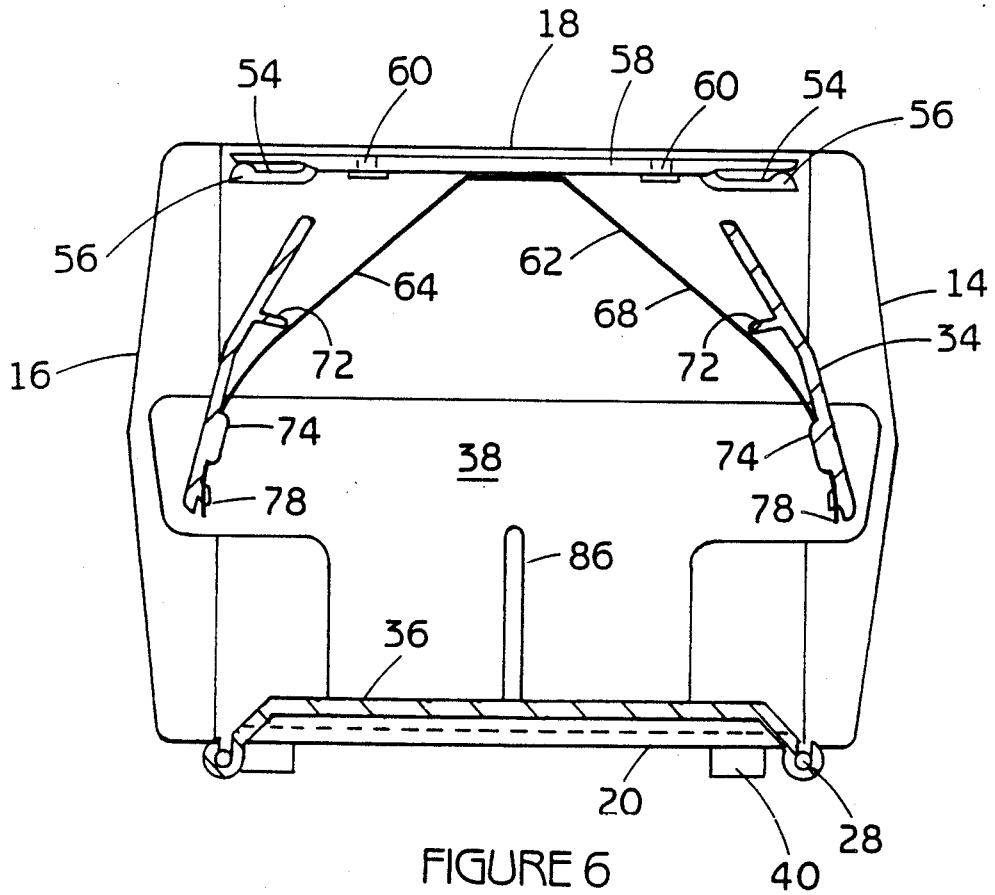
FIG. 6 is a section view along line 6—6 of FIG. 1, particularly showing the arrangement of the pressure plate and the spring.
Figure 7:
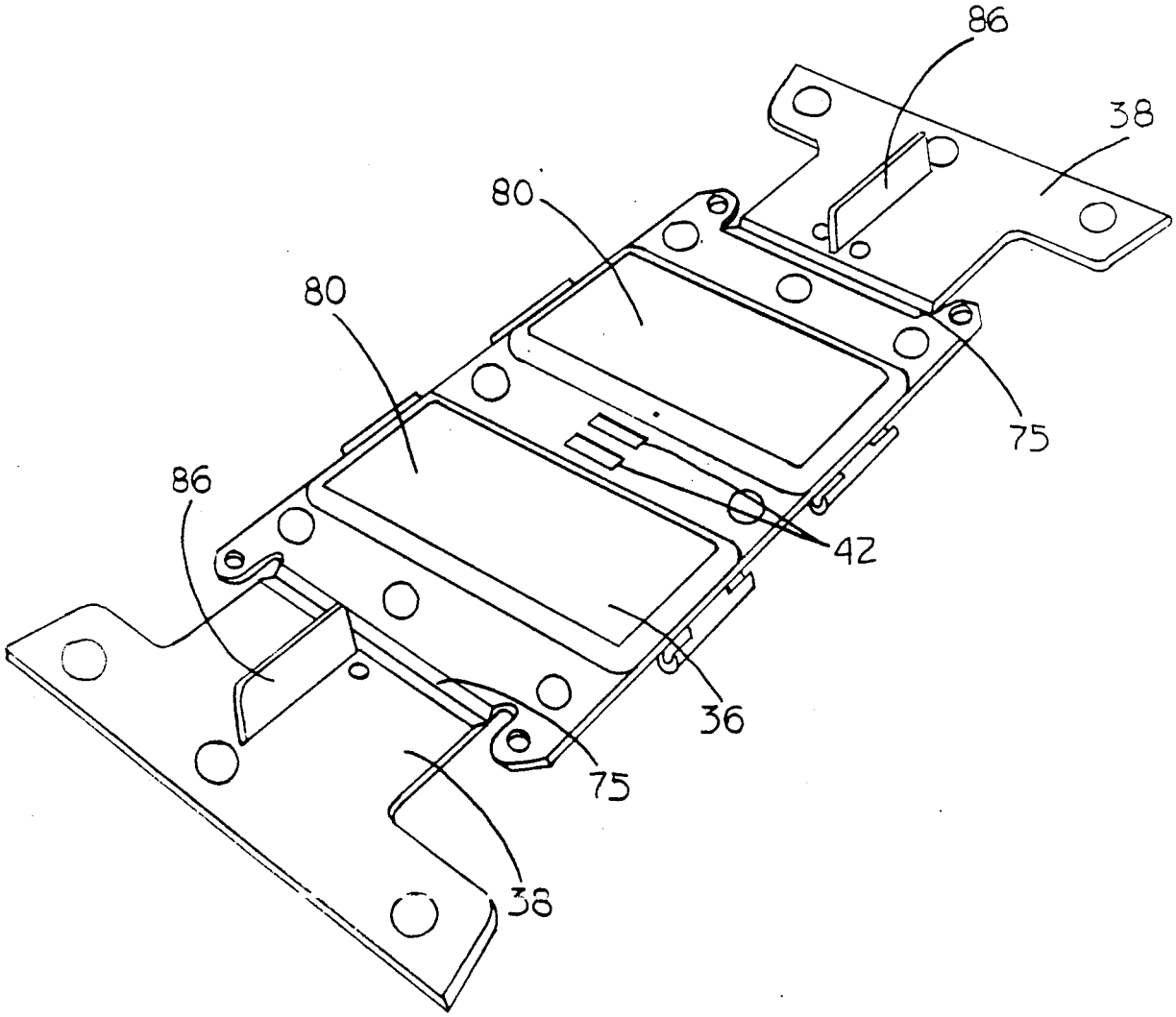
FIG. 7 is a perspective view of the integral base and side wall as it is molded in the flat.
Figure 8:
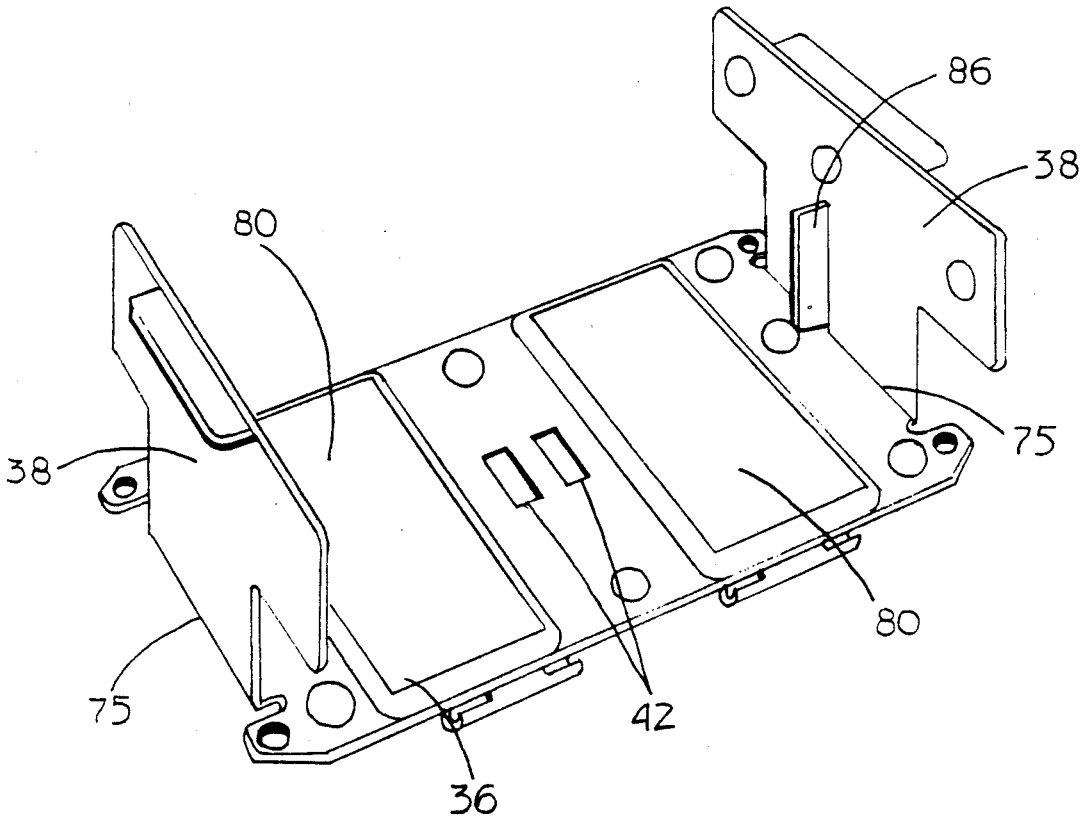
FIG. 8 is a perspective view of the integral base and side wall as it is bent along its hinges to fit inside of the table model napkin dispenser.
Figure 10:
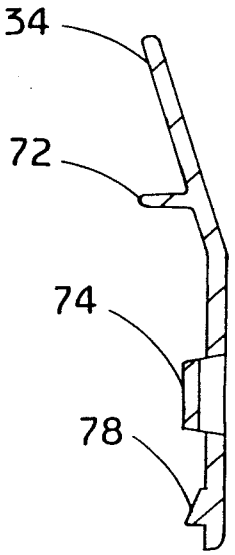
FIG. 10 is a section view taken along line 10—10 of FIG. 9.
Figure 9:
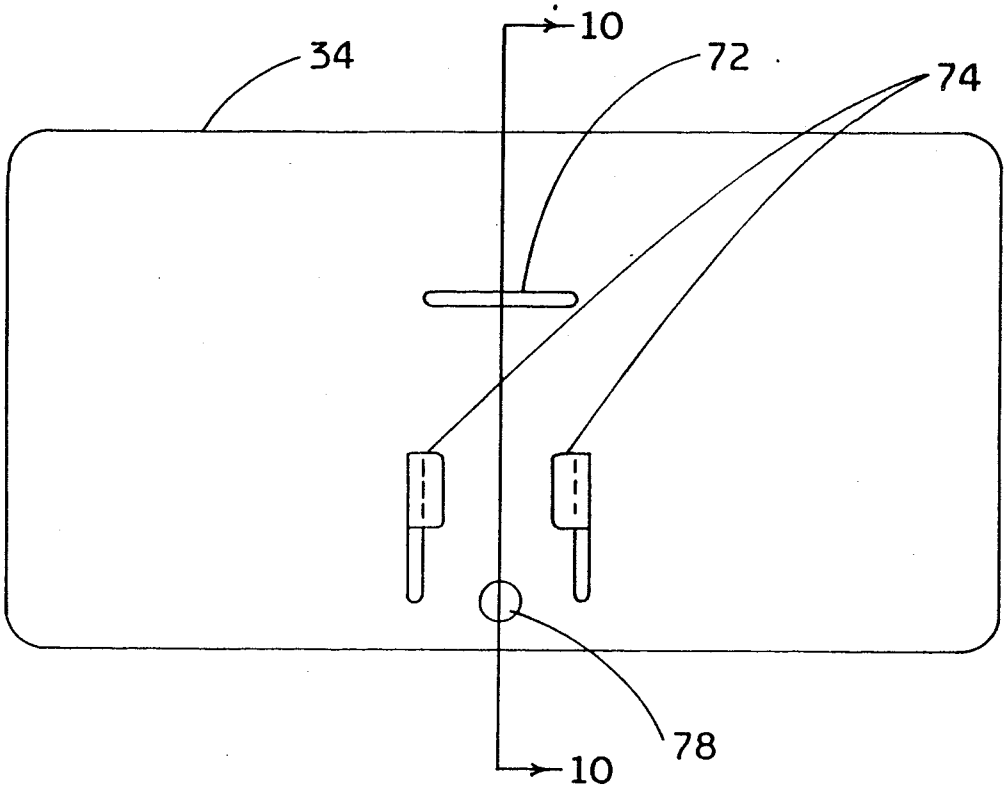
FIG. 9 is a back view of one of the pressure plates.
Figure 12:
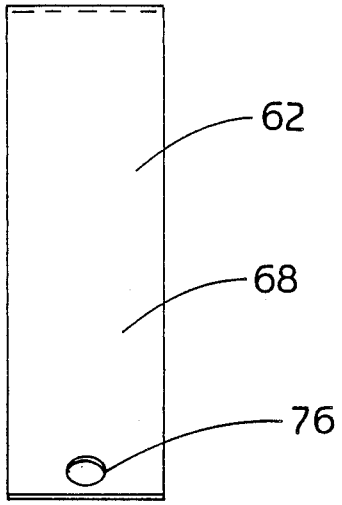
FIG. 12 is a side view of the spring, the spring being bent into appropriate shape but not installed within the table model napkin dispenser.
Figure 13:
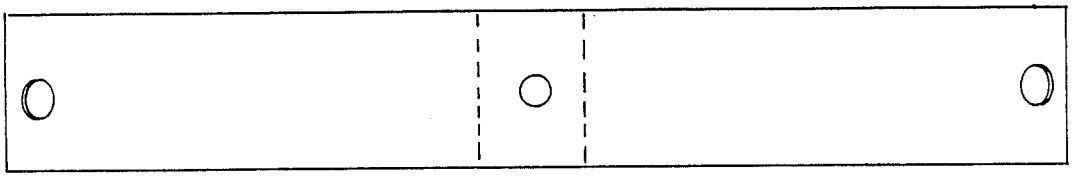
FIG. 13 is a front view of the spring, the spring being bent into appropriate shape but not installed within the table model napkin dispenser.
Figure 11:
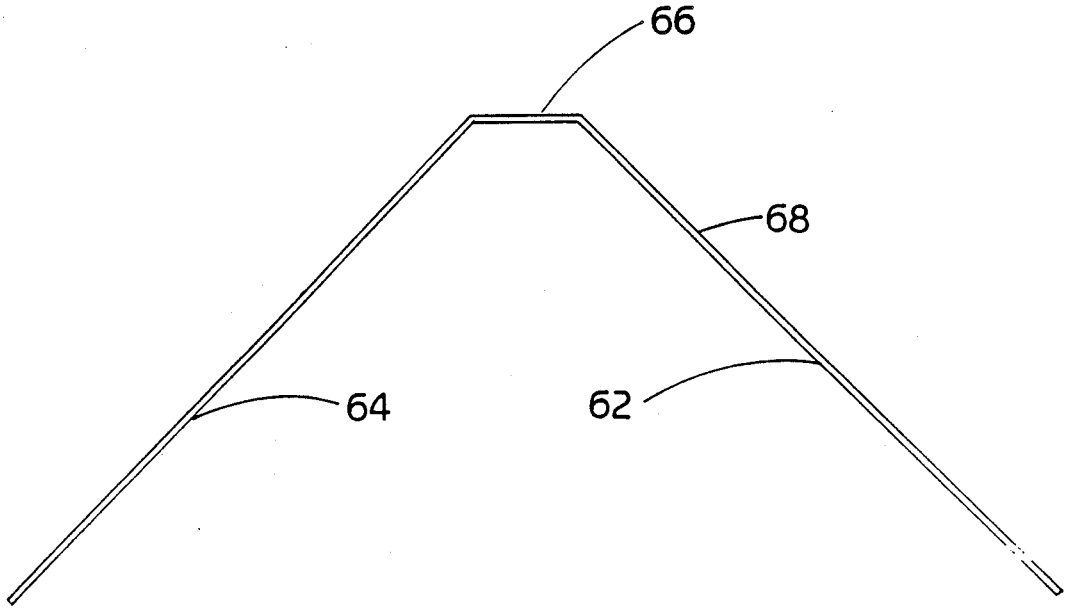
FIG. 11 is a top view of the spring, the spring being bent into appropriate shape but not installed within the table model napkin dispenser.

The clip 58 also acts as a mount for suspending a spring 62 that is attached to the back of the pressure plates 34. Preferably, the length of a band of 0.010 inch thick spring steel is bent in two places to form three segments 64, 66, and 68. The segments 64 and 68 are both bent down at an angle of 45° from segment 66, forming the symmetrical configuration as shown in FIG. 6. The spring 62 is inserted through slots 70 in the clip 58 so that the segment 66 is held behind the clip 58, and segments 64 and 68 hang from the clip 58. The ends of segments 64 and 68 are each rounted over a tab 72 and through grooves 74 in a respective pressure plate 34. Each of the segments 64 and 68 have a hole 76 that mates with a protrusion 78 in each of the pressure plates 34, thereby securing the spring 62 to the back side of each of the pressure plates 34. When segments 64 and 68 are secured to the back of a respective pressure plate 34, the ends of segments 64 and 68 are flush with the bottom edge of the pressure plate 34.

The routing of the segments 64 and 68 behind a tab 72 and then through grooves 74 in each of the pressure plates 34, coupled with the 45° angle at which the 0.010 inch thick spring steel segment 64 and 68 are bent, cants and biases the pressure plates 34 in such a way as to provide a proper force profile against the napkins. This application of the proper force profile against the napkins enables the user to extract napkins individually with ease and without jamming. The clip 58 is preferably composed of celcon, and the pressure plates 34 are preferably composed of polycarbonate or ABS.

In loading the napkin dispenser 10 with napkins, the edges of the napkins rest upon the base 36 and between the side walls 38. The base 36 and the side walls 38 are molded in a single flat piece, preferably of polycarbonate or ABS, and are molded with hinges at the juncture between the base 36 and side walls 38 so that the side walls 38 may be bent perpendicular to the base 36 in the assembly of the napkin dispenser 10. The napkins rest on an inside surface 80 of the base 36, whereas the outside surface 82 of the base 36 is the bottom 20 of the cabinet 12. The base 36 is attached to the rest of the cabinet 12 through rivets 84 that go through the rubber legs 40 and the base 26. As explained above, the anchor clip 32 is attached through slots 42 in the bottom 20 of the cabinet 12. The side walls 38 also incorporate a pressure plate stop 86, against which a particular pressure plate 34 will abut when that respective end (front 14 or back 16) of the napkin dispenser 10 is loaded to capacity with napkins. This insures that an equal number of napkins can be placed into each end (front 14 and back 16) of the napkin dispenser 10.

It is understood that the invention is not confined to the particular construction and arrangement of parts herein illustrated and described, but embraces such modified forms thereof as come within the scope of the following claims. It is particularly noted that this invention is not restricted merely to a napkin dispenser having two symmetrical opposing ends, but may encompass a napkin dispenser having only one end through which napkins are dispensed and loaded, or a napkin dispenser having more than two ends through which napkins are dispensed and loaded.

What is claimed is:

1. A dispenser for folded sheets of flexible material comprising:

(a) a cabinet having a front end, a back end, a top, a bottom, and two sides, the bottom of the cabinet having two centrally located slots;

(b) a door forming at least one of the two ends, the door having an access window for extraction of folded sheets of flexible material and means for opening the door;

(c) means for pushing the folded sheets of flexible material against the door; and (d) a clip for securing and detaching the cabinet to and from a horizontal surface, the clip comprising:

(i) a flat plate with a first side and a second side that is independent of the cabinet;

(ii) two vertical barbs that extend vertically from the first side of the flat plate and that engage with the slots in the bottom of the cabinet, the flat plate being disengaged from the cabinet upon pinching of the barbs together; and (iii) means for affixing the second side of the flat plate to the desired surface.

2. The dispenser of claim 1 wherein the means for affixing the second side of the flat plate to the desired horizontal surface is a two-sided adhesive tape.

3. A dispenser for folded sheets of flexible material comprising:

(a) a cabinet having a front end, a back end, a top, a bottom, and two sides, the bottom of the cabinet having two centrally located slots;

(b) a door forming at least one of the two ends, the door having an access window for extraction of folded sheets of flexible material and means for opening the door;

(c) a pressure plate having a front side and a back side that is positioned behind the door on the interior of the cabinet, so that the folded sheets of flexible material are loaded between the front side of the pressure plate and the door;

(d) a leaf spring that pushes against the folded sheets of material, the leaf having a first end attached to the underside of the top of the cabinet and a second end attached to the back side of the pressure plate, the leaf spring being bent to an acute angle relative to a line normal from the surface on which the cabinet rests so as to provide the necessary inflection to bias the pressure plate and to enable a person to easily extract the folded sheets individually and the leaf spring being routed around a tab protruding from the back side of the pressure plate so as to cant the pressure plate in a way that will enable a person to easily extract the folded sheets individually;

(e) an integral base and at least one side wall which are molded as a single flat piece and hinged so that the side wall may be bent perpendicular to the base, the base and side wall bounding the folded sheets of flexible material and the base forming the bottom of the cabinet, the integral base and side wall further including a stop against which the pressure plate may abut against so that the dispenser is not overloaded; and (f) a clip for securing and detaching the cabinet to and from a surface, the clip comprising:

(i) a flat plate with a first side and a second side that is independent of the cabinet;

(ii) two vertical barbs that extend vertically from the first side of the flat plate and that engage with the slots in the bottom of the cabinet, the flat plate being disengaged from the cabinet upon pinching of the barbs together; and (iii) a two-sided adhesive tape for affixing the second side of the flat plate to the desired surface.

* * * * *